US006647972B2

(12) United States Patent
Sato et al.

(10) Patent No.: US 6,647,972 B2
(45) Date of Patent: Nov. 18, 2003

(54) STATE DETERMINING APPARATUS FOR EXHAUST GAS RECIRCULATION SYSTEM

(75) Inventors: Masahiro Sato, Saitama-ken (JP); Yoshihisa Iwaki, Saitama-ken (JP); Masaki Ueno, Saitama-ken (JP); Shusuke Akazaki, Saitama-ken (JP); Yasuyuki Miyahara, Saitama-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 238 days.

(21) Appl. No.: 09/975,002

(22) Filed: Oct. 12, 2001

(65) Prior Publication Data

US 2002/0053343 A1 May 9, 2002

(30) Foreign Application Priority Data

Nov. 8, 2000 (JP) ..... 2000-340275

(51) Int. Cl.[7] ..... F02M 25/07

(52) U.S. Cl. ..... 123/568.16; 123/568.22

(58) Field of Search ..... 123/568.16, 568.21, 123/568.22; 60/274, 276, 277, 288; 73/116, 117.3; 204/425, 426

(56) References Cited

U.S. PATENT DOCUMENTS

| | | | | |
|---|---|---|---|---|
| 5,010,762 | A * | 4/1991 | Logothetis et al. | 73/116 |
| 5,049,254 | A * | 9/1991 | Logothetis et al. | 204/425 |
| 6,062,204 | A * | 5/2000 | Cullen | 123/568.22 |
| 6,477,830 | B2 * | 11/2002 | Takakura et al. | 60/277 |
| 2002/0011066 | A1 * | 1/2002 | Takakura et al. | 60/277 |
| 2002/0189599 | A1 * | 12/2002 | Kotwicki et al. | 123/568.16 |

* cited by examiner

*Primary Examiner*—Willis R. Wolfe
(74) *Attorney, Agent, or Firm*—Arent Fox Kintner Plotkin & Kahn, PLLC

(57) ABSTRACT

A state determining apparatus for an exhaust gas recirculation system is provided for appropriately determining the state of an exhaust gas recirculation system including an EGR passage. An exhaust gas recirculation system is arranged in an exhaust system of an internal combustion engine including an EGR passage for recirculating a portion of exhaust gases to an intake system in accordance with an operating state of the internal combustion engine. The state determining apparatus comprises a humidity sensor arranged in the EGR passage for detecting a humidity within the EGR passage, and an ECU for determining the state of the exhaust gas recirculation system based on a result detected by the humidity sensor.

3 Claims, 7 Drawing Sheets

STATE DETERMINING APPARATUS FOR EXHAUST GAS RECIRCULATION SYSTEM

BACKGROUND OF THE INVENTION

1. Field of the Invention

The present invention relates to a state determining apparatus for determining the state of an exhaust gas recirculation system which includes an EGR passage for recirculating a portion of exhaust gases to an intake system in accordance with an operating state of an internal combustion engine.

2. Description of the Prior Art

A conventional state determining apparatus of the type mentioned above is known, for example, in Laid-open Japanese Patent Application No. 63-243446. This known state determining apparatus is provided for determining a failure of an EGR control valve for controlling an ERG passage to open and close, and comprises a temperature sensor at a location downstream of the EGR control valve in the EGR passage for detecting the temperature of an EGR gas. Then, if a detected EGR gas temperature is lower than a first predetermined temperature when the EGR control valve is supplied with a signal for opening the EGR passage, the state determining apparatus determines that the EGR control valve has failed due to a stick or the like because no EGR gas is actually flowing through the EGR passage. On the other hand, if a detected EGR gas temperature is higher than a second predetermined temperature lower than the first predetermined temperature when the EGR control valve is supplied with a signal for closing the EGR passage, the state determining apparatus determines that the EGR control valve has failed because the EGR gas is actually passing through the EGR passage.

As described above, the conventional failure determining apparatus relies on the EGR gas temperature detected by the temperature sensor provided in the EGR passage as a parameter for determining a failure of the EGR control valve. However, characteristically, the "temperature" is inherently slow in change, low in responsibility, and susceptible to a variety of factors such as an external air temperature and the like. With such characteristics of the temperature, the failure determining apparatus may fail to appropriately determine a failure of the EGR control valve, and would suffer from a lower accuracy of determination when it is applied to the determination of a leak on the EGR passage or the like, due to a large length of the EGR passage which causes the characteristics of the temperature to prominently appear.

OBJECT AND SUMMARY OF THE INVENTION

The present invention has been made to solve the problem mentioned above, and it is an object of the invention to provide a state determining apparatus for an exhaust gas recirculation system which is capable of appropriately determining the state of an exhaust gas recirculation system including an EGR passage.

To achieve the above object, the present invention provides an exhaust gas recirculation system state determination apparatus for determining a state of an exhaust gas recirculation system arranged in an exhaust system of an internal combustion engine including an EGR passage for recirculating a portion of exhaust gases to an intake system in accordance with an operating state of the internal combustion engine, characterized by comprising a humidity sensor arranged in the EGR passage for detecting a humidity within the EGR passage; and exhaust gas recirculation system state determining means for determining the state of the exhaust gas recirculation system based on a result detected by the humidity sensor.

According to this state determining apparatus, the humidity of exhaust gases in the EGR passage (hereinafter called the "EGR gas") is detected by the humidity sensor arranged in the EGR passage, and the state of the exhaust gas recirculation system including the EGR passage is determined by the exhaust gas recirculation system state determining means based on the result of detection. Since the EGR gas is a portion of exhaust gases generated by combustion, it generally includes a large amount of moisture, and therefore the humidity reflects the state of the exhaust gas recirculation system including the EGR passage through which the EGR gas passes. It is therefore possible to appropriately determine the state of the exhaust gas recirculation system including the EGR passage, for example, a failure due to a leak and the like in the EGR passage based on the result of detection made by the humidity sensor. Also, since the humidity is characteristically high in responsibility and less susceptible to other factors, as compared with the temperature, a higher determination accuracy can be achieved than when the temperature is used as a parameter.

Preferably, in the state determining apparatus, the exhaust system includes a main passage, a bypass passage branched off the main passage, an adsorbent arranged in the bypass passage and capable of adsorbing hydrocarbons and moisture, and switching means for switching an exhaust passage to the main passage and to the bypass passage, wherein the exhaust passage is switched to the bypass passage by the switching means after the internal combustion engine has been started to adsorb hydrocarbons within exhaust gases on the adsorbent, and the adsorbent hydrocarbons are desorbed and recirculated to the intake system through the EGR passage.

According to this preferred embodiment, the EGR passage is used as a passage for recirculating hydrocarbons desorbed from the adsorbent, on which they have once been adsorbed, to the intake system. Also, since the adsorbent is capable of adsorbing moisture as well as hydrocarbons, there is a mutually close relationship between hydrocarbons and moisture with respect to their adsorption and desorption states, and they have a high correlation. Stated another way, the humidity of the EGR gas reflects not only the state in the EGR passage but also the state of the adsorbent during desorption. It is therefore possible to appropriately determine based on the result of detection made by the humidity sensor the state of the adsorbent, for example, whether or not hydrocarbons have been completely desorbed from the adsorbent.

In a general EGR device, a majority of EGR passage is formed in a cylinder block of an engine, and the EGR passage has a relatively short length around the engine, so that a leak from the EGR passage does not cause a grave problem. On the other hand, an EGR passage containing an adsorbent as described above is often formed as a relatively long EGR pipe for connecting the downstream side of the adsorbent to an intake system, so that the EGR pipe is more susceptible to a leak due to cracking and the like possibly caused by vibrations of the engine and the difference in thermal expansion in the exhaust system. According to this preferred embodiment, it is possible to efficiently determine a leak from the EGR passage and the state of the adsorbent in such a situation based on the result of detection made by the common humidity sensor.

Preferably, in the state determining apparatus, the exhaust gas recirculation system state determining means includes humidity integrated value calculating means for calculating an integrated value of the result detected by the humidity sensor during desorption of hydrocarbons from the adsorbent; and desorption state determining means for determining a desorption state of the adsorbent based on the integrated value calculated by the humidity integrated value calculating means.

As described above with respect to the preferred embodiment, the result of detection made by the humidity sensor during the desorption of hydrocarbons from the adsorbent precisely reflects the amount of desorbed hydrocarbons, and has a high correlation to this. It is therefore possible to appropriately determine a desorption state of the adsorbent, for example, the completion of adsorption based on the calculation of the humidity integrated value which is an integrated value of the result of detection made by the humidity sensor.

DETAILED DESCRIPTION OF THE EMBODIMENT

Figure 1:
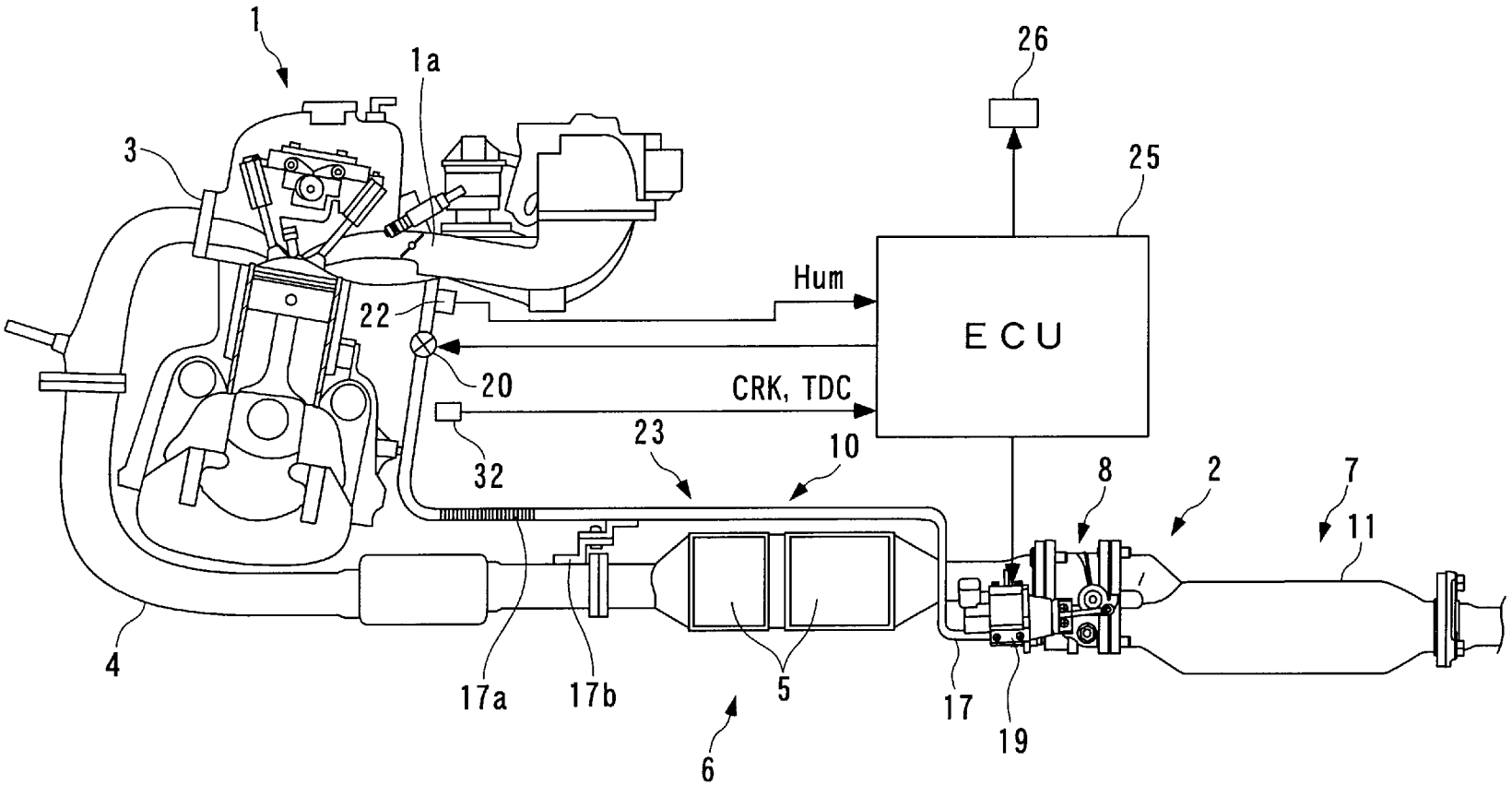
FIG. 1 is a schematic diagram illustrating the configuration of an internal combustion engine to which a state determining apparatus for an exhaust gas recirculation system according to one embodiment of the present invention is applied.

In the following, a preferred embodiment of the present invention will be described in detail with reference to the accompanying drawings. FIG. 1 illustrates an internal combustion engine in which the embodiment of the present invention is applied. In the illustrated internal combustion engine (hereinafter simply referred to the "engine") 1, an exhaust system 2 is configured to emit exhaust gases emitted from the engine 1 to the atmosphere after they are purified, and to recirculate a portion of the exhaust gases to the engine 1 (EGR), and has an exhaust pipe 4 connected to the engine 1 through an exhaust manifold 3.

A catalyzer 6 having two three-way catalysts 5, and a hydrocarbon adsorber 7 for adsorbing hydrocarbons are provided at intermediate locations in the exhaust pipe 4 for purifying exhaust gases. The two three-way catalysts 5 of the catalyzer 6 are arranged adjacent to each other along the exhaust pipe 4. The three-way catalysts 5, when activated at or above a predetermined temperature (for example, 300° C.), purify harmful substances (hydrocarbons, carbon monoxide and nitrogen compounds) in exhaust gases passing through the catalyzer 6 by oxidation-reduction catalyst actions.

Figure 2:
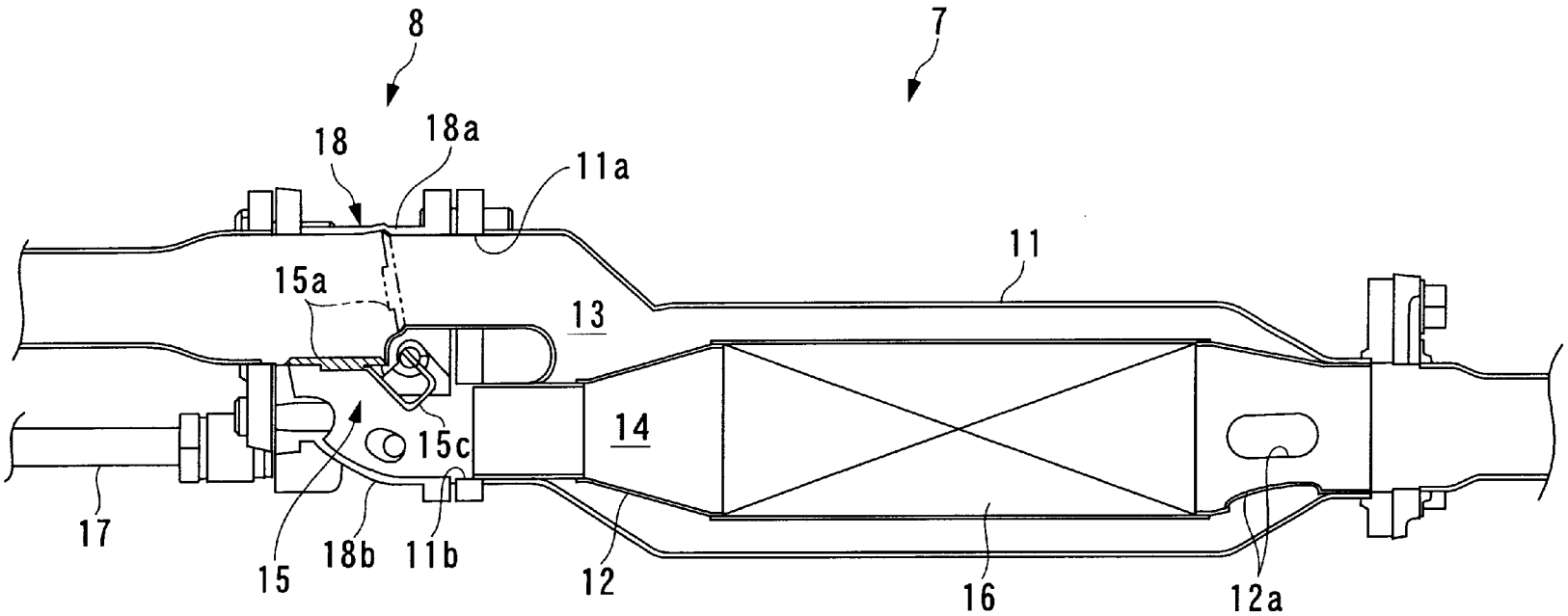
FIG. 2 is an enlarged cross-sectional view illustrating a hydrocarbon adsorber.
Figure 3:
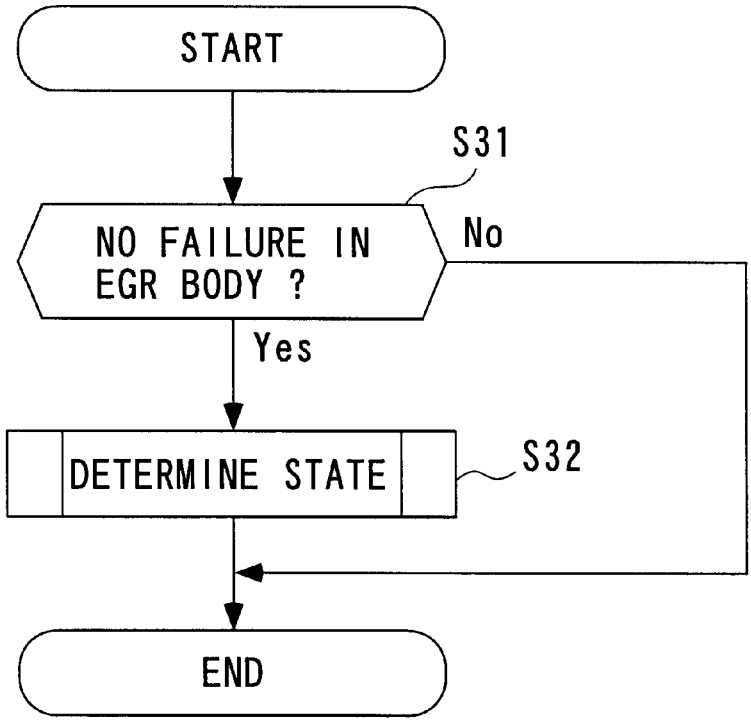
FIG. 3 is a flow chart illustrating a routine for determining the execution of a state determination for an exhaust gas recirculation system.

The hydrocarbon adsorber 7, in turn, is arranged in the exhaust pipe 4 at a location downstream of the catalyzer 6 for adsorbing hydrocarbons in exhaust gases during a starting period (for example, about 30–40 seconds after the start) in a state in which the three-way catalysts 5 have not been activated, thereby largely reducing the amount of hydrocarbons emitted in the atmosphere. As illustrated in FIGS. 1 and 2, the hydrocarbon adsorber 7 is coupled to a downstream end of the catalyzer 6 through an exhaust passage switch 8. The hydrocarbon adsorber 7 comprises a case 11 forming a substantially cylindrical shell; a bypass exhaust pipe 12 arranged within the case 11; and a cylindrical HC adsorbent 16 filled in the middle of the bypass exhaust pipe 12 for adsorbing hydrocarbons contained in exhaust gases which flow into the bypass exhaust pipe 12.

As illustrated in FIG. 2, the case 11 has its upstream end branched into two: an upper opening 11*a* in communication with a main passage 13 having an annular cross-section, formed between the case 11 and the bypass exhaust pipe 12, and a lower opening 11*b* in communication with a bypass passage 14 which defines an internal space of the bypass exhaust pipe 12.

The bypass exhaust pipe 12 has its upstream end hermetically connected to the inner wall of the lower opening 11*b* of the case 11, and its downstream end likewise hermetically connected to the inner wall of a downstream end of the case 11. The bypass exhaust pipe 12 is formed with a plurality (for example, five) of elongated communication holes 12*a* formed in a downstream end portion at equal intervals from one another in the circumferential direction. The main passage 13 and the bypass passage 14 have their downstream ends communicating through these communication holes 12*a*.

The HC adsorbent 16 is comprised of a honeycomb core (not shown), made of a metal, which carries zeolite on its surface, so that as exhaust gases flowing into the bypass passage 14 passes through the interior of the HC adsorbent 16, hydrocarbons and moisture contained in the exhaust gases are adsorbed by zeolite. Zeolite, which has high heat resistant properties, adsorbs hydrocarbons in a low temperature state (for example, below 100° C.), desorbs hydrocarbons once adsorbed thereby when its temperature rises to a predetermined temperature or higher (for example, 100–250° C.). It should be noted that the zeolite is only required to have the ability of adsorbing hydrocarbons and moisture and is not particularly limited in the type. This embodiment employs a mixture of USY (Y-type), Ga-MFI and ferrierite.

The exhaust passage switch 8 (switching means) is provided for coupling the hydrocarbon adsorber 7 in the foregoing configuration to the catalyzer 6, and for selectively switching the passage of exhaust gases downstream of the catalyzer 6 to the main passage 13 and to the bypass passage 14 in accordance with the activated state of the three-way catalysts 5. The exhaust passage switch 8 has a substantially cylindrical connecting pipe 18; and a switching valve 15 arranged within the connecting pipe 18 for switching the exhaust passage. The connecting pipe 18 is comprised of a main pipe section 18*a* for hermetically communicating the downstream end of the catalyzer 6 with the main passage 13 of the hydrocarbon adsorber 7; and a branch pipe section 18*b* branched off an upstream portion of the main pipe section 18*a* for hermetically communicating the downstream end of the catalyzer 6 with the bypass passage 14.

The switching valve 15 in turn has a discoidal valve body 15*a*, and an arm 15*c* in a predetermined shape for supporting the valve body 15*a* at one end thereof. As the arm 15*c* is driven to rotate over a predetermined angle about the other end by a switching valve driving unit 19 (see FIG. 1) under control of an ECU 25, later described, the valve body 15*a* pivotally moves to open one of the main pipe section 18*a* and the branch pipe section 18*b* and to close the other one. Specifically, when the valve body 15*a* opens the main pipe section 18*a* and closes the branch pipe section 18*b* as indicated by solid lines in FIG. 2, the exhaust passage is switched to the main passage 13. On the contrary, when the valve body 15*a* stays at a position indicated by a two-dot chain line, the exhaust passage is switched to the bypass passage 14. The arm 15*c* is provided with a twisted coil spring, not shown, at the other end thereof, so that the exhaust passage is normally biased to the main passage 13 by the twisted coil spring.

An EGR device 10 for recirculating a portion of exhaust gases to the engine 1 is comprised of an EGR passage 17, an EGR control valve 20, and the like. As illustrated in FIG. 1, the EGR passage 17, which is comprised of a long bent EGR tube made, for example, of stainless steel, has one end thereof connected to and supported by a connecting pipe 18 and inserted into a branch pipe section 18*b*, and the other end connected to an intake pipe 1*a* of the engine 1. A bellows 17*a* is formed in the middle of the EGR tube for absorbing vibrations of the engine 1 and a difference in thermal expansion of the exhaust system 2. The EGR tube is fixed to and supported by the exhaust pipe 4 with a fixture 17*b* at a location upstream of the bellows 17*a*. The EGR control valve 20, which may be comprised of an electromagnetic valve, is arranged at a location of the EGR passage 17 near the engine 1 for opening and closing the EGR passage 17 and changing the opening of the EGR passage 17, under control of the ECU 25, to actuate/stop the EGR and control the amount of EGR.

According to the foregoing configuration, the exhaust passage is switched to the bypass passage 14 by the exhaust passage switch 8 immediately after a cold start of the engine 1, thereby introducing exhaust gasses passing through the catalyzer 6 into the bypass passage 14. After hydrocarbons and moisture contained in the exhaust gases have been adsorbed by the HC adsorbent 16, the exhaust gases are emitted to the atmosphere. Subsequently, upon determining that hydrocarbons have been fully adsorbed by the HC adsorbent 16, the exhaust passage is switched to the main passage 13, thereby introducing the exhaust gases into the main passage 13 through the main pipe section 18*a* of the connecting tube 18 to emit the exhaust gases to the atmosphere. Also, as the EGR control valve 20 is opened to operate the EGR, a portion of the exhaust gases is recirculated to the intake pipe la through the branch pipe section 18*b* and the EGR passage 17 as an EGR gas. Hydrocarbons desorbed from the HC adsorbent 16 are sent to the intake pipe la by the EGR gas and burnt by the engine 1. In other words, in this embodiment, the exhaust gas recirculation system 23 is comprised of the EGR device 10 including the EGR passage 17, the bypass passage 14 including the HC adsorbent 16, and the like.

The EGR passage 17 is provided with a humidity sensor 22 attached at a location downstream of the EGR control valve 20. The humidity sensor 22 detects a humidity Hum within the EGR passage 17, and outputs a signal indicative of the detected humidity to the ECU 25. The ECU 25 is also supplied with a CRK signal and a TDC signal, which are pulse signals, from a crank angle sensor 32, respectively. The CRK signal is generated every predetermined crank angle as a crank shaft, not shown, of the engine 1 is rotated, while the TDC signal is generated, for example, each time the crank shaft is rotated over 180 degrees. Further, connected to the ECU 25 is an alarm lamp 26 which is turned on upon determining, for example, that the humidity sensor 22 fails.

In this embodiment, the ECU 25 comprises exhaust gas recirculation system state determining means, humidity integrated value calculating means, and desorption state determining means. The ECU 25 may be implemented by a microcomputer which is comprised of an I/O interface, a CPU, a RAM, a ROM, and so on. Signals detected by the aforementioned sensors such as the humidity sensor 22 are inputted to the CPU after subjected to A/D conversion, waveform reshaping and so on in the I/O interface. The CPU controls the EGR control valve 20 in response to these detection signals and in accordance with a control program and the like stored in the ROM, as well as performs control processing as described below.

Next, the control processing executed by the ECU 25 will be described with reference to FIGS. 3 through 7. The control processing illustrated in FIG. 3 determines whether or not the ECU 25 should execute a state determination for the exhaust gas recirculation system 23 including the EGR passage 17. In this processing, it is determined at step 31 (labeled as "S31" in the figure. The same is applied to the following description) whether or not a failure has been sensed in the EGR body, for example, the EGR control valve 20 and the like except for the EGR passage 17. A failure in the EGR body is sensed separately by control processing, not shown. If the answer at step 31 is No, the ECU 25 executes a state determination for the exhaust gas recirculation system 23, later described (step 32). On the other hand, if the answer at step 31 is Yes, indicating that the EGR body fails, the processing skips step 32, since the state determination cannot be correctly made, followed by termination of the program.

Figure 4:
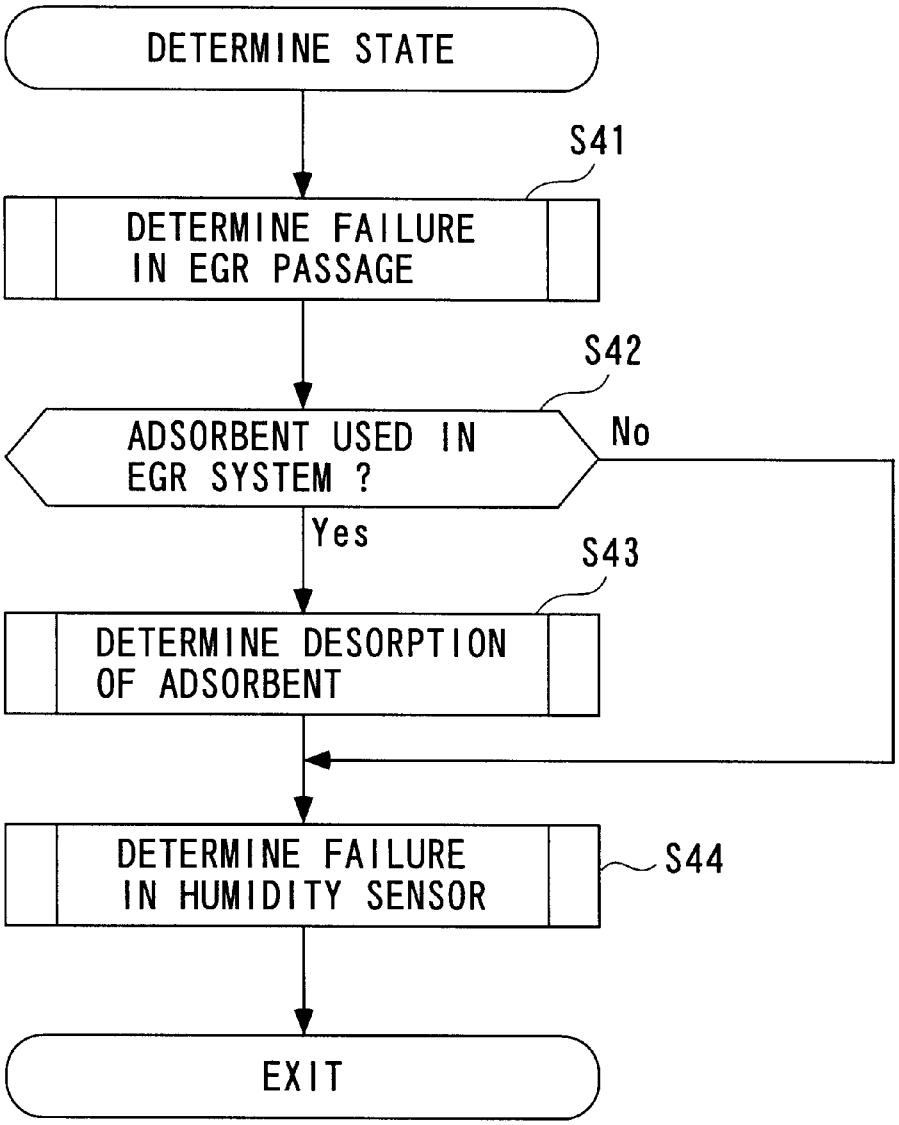
FIG. 4 is a flow chart illustrating a main flow of the state determination processing program for the exhaust gas recirculation system.

FIG. 4 illustrates a main flow of the state determination processing program for the exhaust gas recirculation system 23. First, in this program, the ECU 25 executes a failure determination for the EGR passage 17 (step 41). Next, it is determined whether or not the exhaust gas recirculation system 23 has an adsorbent (step 42). In this embodiment, the HC adsorbent 16 is provided and therefore the answer at step 41 is Yes, so that the ECU 25 next executes a desorption determination for the HC adsorbent 16 (step 43). After the execution of step 43, or if the answer at step 42 is No, the program proceeds to step 44, where the ECU 25 executes a failure determination for the humidity sensor 22, followed by termination of the program. As will be described later, the foregoing processing is executed using a humidity value Hum detected by the humidity sensor 22 (hereinafter called the "detected humidity value").

Figure 5:
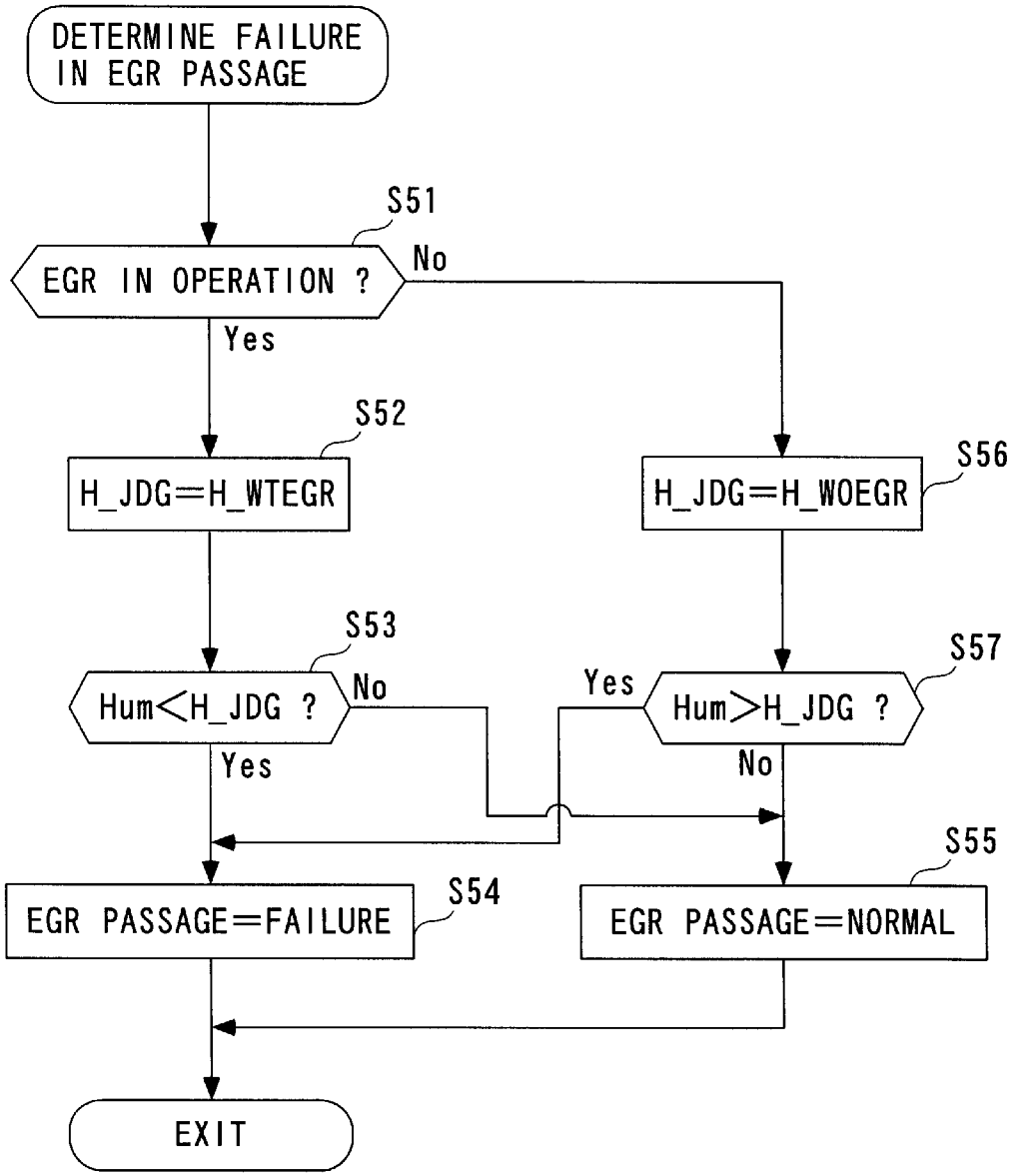
FIG. 5 is a flow chart illustrating a subroutine for failure determination for an EGR passage.

FIG. 5 illustrates a subroutine for the failure determination for the EGR passage 17 executed at step 41 in FIG. 4. In this subroutine, it is first determined whether or not the EGR is in operation, i.e., whether or not the EGR control valve 20 is opened (step 51). If the answer at step 51 is Yes, indicating that the EGR is in operation, a failure threshold H_JDG for the EGR passage 17 is set to a predetermined value H_WTEGR (for example, 60%) for the operative EGR (step 52).

Next, it is determined whether or not the detected humidity value Hum is smaller than the set threshold H_JDG (step 53). If the answer at step 53 is Yes, i.e., when Hum<H_JDG, indicating that the EGR is in operation, it is determined that the EGR passage 17 is experiencing a failure such as a leak, predicating that the detected humidity value Hum is extremely low although a highly humid EGR gas including a large amount of moisture should be flowing through the EGR passage 17 (step 54). In this event, the predetermined alarm lamp 26 is turned on to notify the operator of the occurrence of the failure.

On the other hand, if the answer at step 53 is No, i.e., when Hum≧H_JDG, it is determined that the EGR passage 17 is normal (step 55), followed by termination of the subroutine.

If the answer at step 51 is No, i.e., when the EGR is not in operation, the failure threshold H_JDG for the EGR passage 17 is set to a predetermined value H_WOEGR for the inoperative EGR (for example, 40%) smaller than the predetermined value H_WTEGR for operative EGR (step 56). It is next determined whether or not the detected humidity value Hum is larger than the failure threshold H_JDG (step 57). If the answer at step 57 is Yes, i.e., when Hum>H_JDG, the routine proceeds to step 54 to determine that the EGR passage 17 fails, predicating that the humidity in the EGR passage 17 must be low because of the inoperative EGR but is actually not.

On the other hand, if the answer at step 57 is No, i.e., when Hum≦H_JDG, the subroutine proceeds to step 55, where the EGR passage 17 is determined to be normal, followed by termination of the subroutine.

Figure 6:
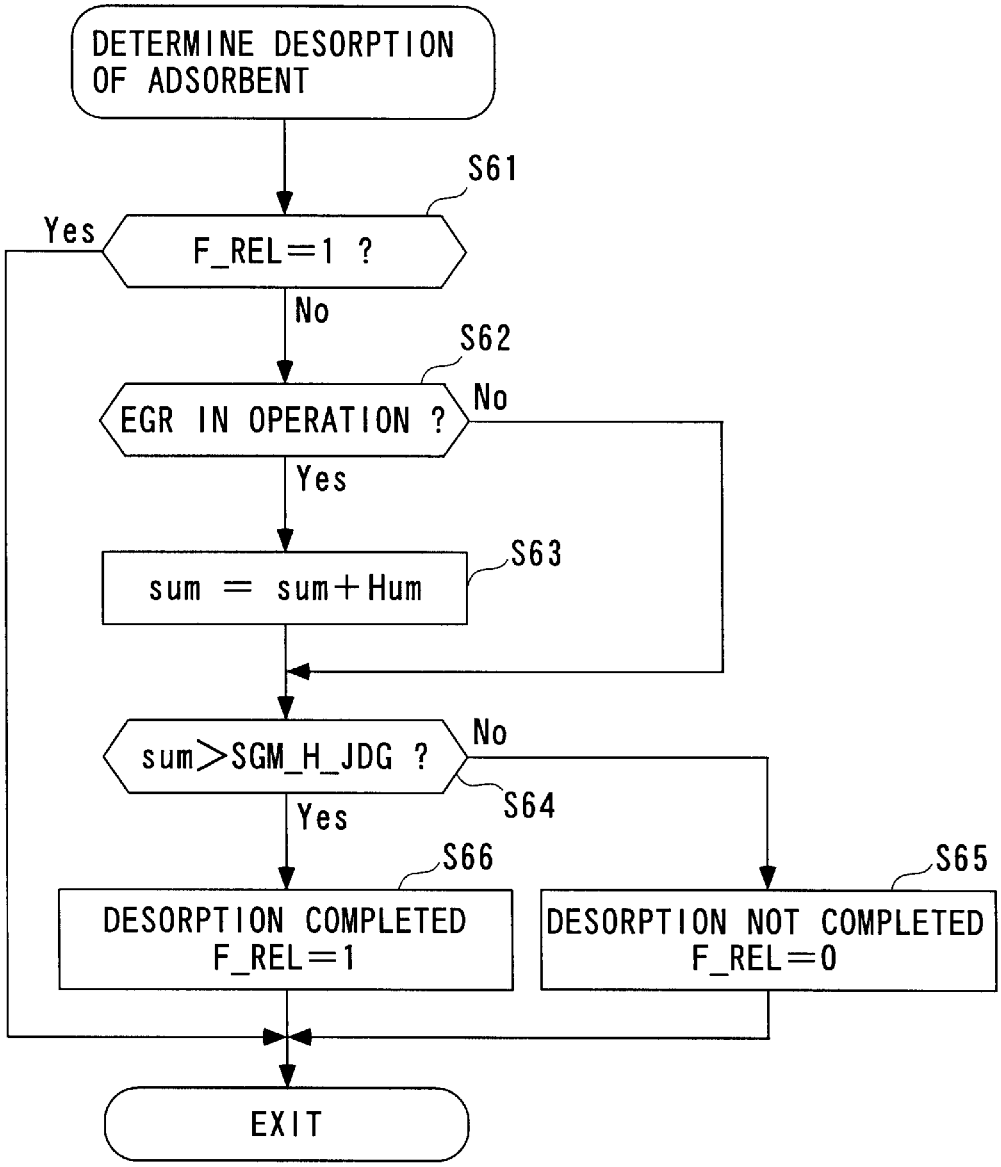
FIG. 6 is a flow chart illustrating a subroutine for desorption determination for an HC adsorbent.

FIG. 6 illustrates a subroutine for the desorption determination for the HC adsorbent 16 executed at step 43 in FIG. 4. In this subroutine, it is first determined whether or not a desorption complete flag F_REL indicating that the HC adsorbent 16 has completely desorbed is "1" (step 61). The desorption complete flag F_REL is reset to "0" when an ignition switch is turned on. If the answer at step 61 is No, i.e., when the completion of desorption has not been sensed, it is determined whether or not the EGR is in operation (step 62), in a manner similar to step 51 in FIG. 5. If the answer at step 62 is No, indicating that the EGR is not in operation, the subroutine proceeds to step 64, later described.

On the other hand, if the answer at step 62 is Yes, indicating that the EGR is in operation, a currently detected humidity value Hum is added to a humidity integrated value sum up to the preceding time, and the resulting value is set to the current humidity integrated value sum (step 63). The humidity integrated value sum is reset to "0" when the ignition switch is turned on, so that the humidity integrated value sum represents an integrated value of the detected humidity value Hum detected from the start of the engine 1 during the EGR operation, i.e., during desorption of hydrocarbons from the HC adsorbent 16.

Next, it is determined whether or not the humidity integrated value sum calculated as described above is larger than a threshold SGM_H_JDG therefor (step 64). If the answer at step 64 is No, i.e., when sum≦SGM_H_JDG, the desorption complete flag F_REL is held at "0" determining that the HC adsorbent 16 has not completely desorbed (step 65). On the other hand, if the answer at step 64 is Yes, i.e., when the humidity integrated value sum exceeds the threshold SGM_H_JDG, it is determined that the HC adsorbent 16 has completely desorbed, and the desorption complete flag F_REL is set to "1" for indicating to that effect (step 66). Also, if the answer at step 61 is Yes, i.e., the desorption complete flag F_REL is equal to 1 (F_REL=1), indicating that the completion of desorption has been sensed, the subroutine is terminated without further processing. In other words, once the completion of desorption has been sensed, the completion of desorption is not determined until the next operation.

In the foregoing manner, the desorption determination relies on the humidity integrated value sum, which is the integrated value of the detected humidity value Hum during desorption of hydrocarbons from the HC adsorbent 16, as a parameter to determine that the HC adsorbent 16 has completely desorbed when the humidity integrated value sum exceeds the associated threshold. As described above, since the HC adsorbent 16 is capable of adsorbing moisture as well as hydrocarbons, the detected humidity value Hum found in the manner described above precisely reflects the amount of desorbed hydrocarbons, and has a high correlation to the amount of desorbed hydrocarbons. It is therefore possible to appropriately determine that the HC adsorbent 16 has completely desorbed based on the humidity integrated value sum.

Figure 7:
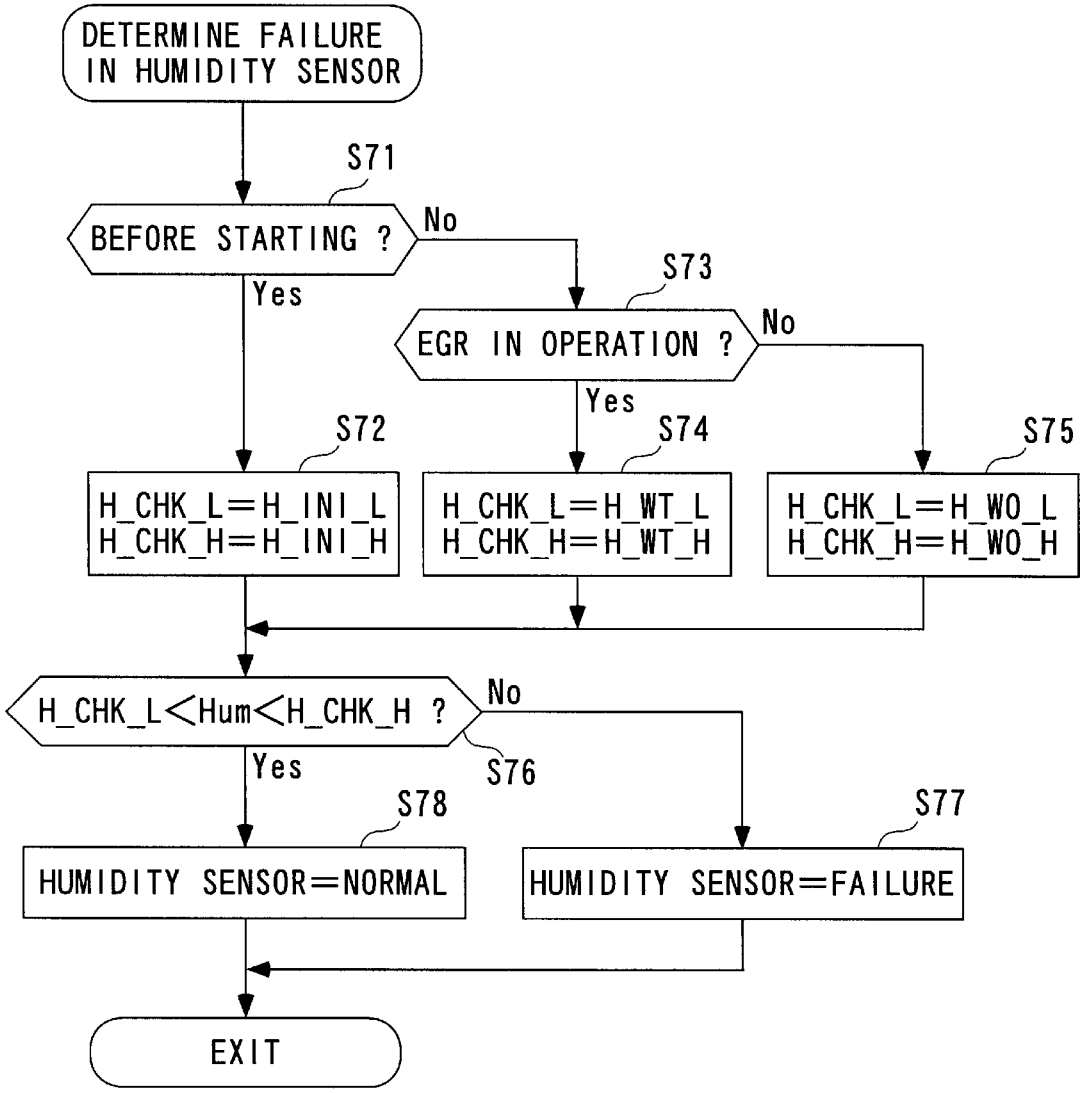
FIG. 7 is a flow chart illustrating a subroutine for failure determination for a humidity sensor.

FIG. 7 illustrates a subroutine for the failure determination for the humidity sensor 22 executed at step 44 in FIG. 4. First, in this subroutine, it is determined whether or not the engine 1 is before starting, specifically, whether or not cranking has not been started (step 71). If the answer at step 71 is Yes, i.e., when the engine 1 is before starting, the subroutine proceeds to step 72, where a lower limit failure threshold H_CHK_L and an upper limit failure threshold H_CHK_H for the humidity sensor 22 are respectively set to predetermined pre-start values H_INI_L, H_INI_H (for example, 5% and 95%, respectively).

If the answer at step 71 is No, i.e., when the engine 1 has been started, it is determined whether or not the EGR is in operation (step 73). If the answer at step 73 is Yes, indicating that the EGR is in operation, the lower and upper limit failure thresholds H_CHK_L, H_CHK_H are set to predetermined values H_WT_L, H_WT_H for the operative EGR (for example, 60% and 95%, respectively) which are within a narrower range than the predetermined pre-start thresholds H_INI_L, H_INI_H and larger than the threshold value H_WTEGR for the operative EGR for determining a failure in the EGR passage 17 (step 74). On the other hand, if the answer at step 73 is No, indicating that the EGR is not in operation, the lower and upper limit failure thresholds H_CHK_L, H_CKH_H are respectively set to predetermined values H_WO_L, H_WO_H (for example, 5% and 40%, respectively) for the inoperative EGR which are in a range narrower than the predetermined pre-start predetermined values H_INI_L, H_INI_H and smaller than the predetermined value H_WOEGR for the inoperative EGR for determining a failure in the EGR passage 17 (step 75).

In the foregoing manner, the lower and upper limit failure thresholds H_CHK_L, H_CHK_H are set to different values depending on whether or not the engine 1 has been started and whether or not the EGR is in operation because the detected humidity value Hum may lie in a different range depending on a particular operating state. Specifically, the humidity within the EGR passage 17 is often close to the humidity in the atmosphere before the start of the engine 1; indicates a high value when the EGR is in operation because an EGR gas is flowing; and indicates a low value when the EGR is not in operation because no EGR gas is flowing.

Next, it is determined whether or not the detected humidity value Hum lies between the lower limit failure threshold H_CHK_L and the upper limit failure threshold H_CHK_H which have been set at step 72, 74 or 75 (step 76). If the answer at step 76 is No, the humidity sensor 22 is determined to fail from the fact that the detected humidity value Hum is not within a predetermined range (step 77). On the other hand, if the answer at step 76 is Yes, i.e., when H_CHK_L<Hum<H_CHK_H, the humidity sensor 22 is determined to be normal (step 78), followed by termination of the subroutine.

As described above, according to the foregoing embodiment, a failure in the EGR passage 17 such as a leak, the completion of desorption of hydrocarbons from the HC adsorbent 16, and a failure in the humidity sensor 22 itself can be appropriately determined as the state of the exhaust gas recirculation system 23 based on the detected humidity value Hum detected by the humidity sensor 22 provided in the EGR passage 17. In this event, since the humidity is characteristically high in responsibility and less susceptible to other factors, as compared with the temperature, a higher determination accuracy can be achieved than when the temperature is used as a parameter. Particularly, in the foregoing embodiment, the EGR passage 17 is formed as a long EGR pipe which connects the downstream side of the HC adsorbent 16 to the intake pipe 1*a*, so that it is more susceptible to a leak due to cracking and the like possibly caused by vibrations of the engine 1 and the difference in thermal expansion in the exhaust system 2. According to the foregoing embodiment, the determination on a failure in EGR passage 17, determination on the completion of desorption from the HC adsorbent 16, and determination on a failure in the humidity sensor 22 can be efficiently made at a low cost using the humidity sensor 22 alone.

It should be understood that the present invention is not limited to the embodiment described above, but may be implemented in a variety of manners. For example, while the foregoing embodiment determines a failure in the EGR passage 17 and the completion of desorption from the HC adsorbent 16 as the state of the exhaust gas recirculation system 23, the state of the exhaust gas recirculation system 23 is not limited to those, but any other state may be determined as long as it can be determined based on the result detected by the humidity sensor 22. For example, determination may be made on a failure in the EGR control valve 20, the degree of desorption from the HC adsorbent 16, and the like. Also, while in the foregoing embodiment, the humidity sensor 22 is positioned near the engine 1 from a viewpoint that a location around the engine 1 is most affected by vibrations of the engine 1 and susceptible to a failure such as a leak, the humidity sensor 22 may be set at an arbitrary location in the EGR passage 17 whether on the upstream side or the downstream side of the EGR control valve.

Further, while the foregoing embodiment determines based on the result detected by the humidity sensor 22 that the HC adsorbent 16 has completely desorbed, it goes without saying that another humidity sensor may be added at a location downstream of the HC adsorbent 16 for increasing the accuracy of determination. Otherwise, the present invention may be modified in its detailed configuration as appropriate within the spirit and scope of the invention as defined by the appended claims.

As described above in detail, the state determining apparatus for the exhaust gas recirculation system according to the present invention can advantageously make an appropriate determination on the state of the exhaust gas recirculation system including the EGR passage.

What is claimed is:

1. A state determination apparatus for determining a state of an exhaust gas recirculation system arranged in an exhaust system of an internal combustion engine including an EGR passage for recirculating a portion of exhaust gases to an intake system in accordance with an operating state of said internal combustion engine, said apparatus comprising:

a humidity sensor arranged in said EGR passage for detecting a humidity within said EGR passage; and exhaust gas recirculation system state determining means for determining the state of said exhaust gas recirculation system based on a result detected by said humidity sensor.

2. A state determination apparatus according to claim 1, wherein:

said exhaust system includes a main passage, a bypass passage branched off said main passage, an adsorbent arranged in said bypass passage and capable of adsorbing hydrocarbons and moisture, and switching means for switching an exhaust passage to said main passage and to said bypass passage, wherein the exhaust passage is switched to said bypass passage by said switching means after said internal combustion engine has been started to adsorb hydrocarbons within exhaust gases on said adsorbent, and the adsorbent hydrocarbons are desorbed and recirculated to said intake system through said EGR passage.

3. A state determining apparatus according to claim 2, wherein said exhaust gas recirculation system state determining means includes:

humidity integrated value calculating means for calculating an integrated value of the result detected by said humidity sensor during desorption of hydrocarbons from said adsorbent; and desorption state determining means for determining a desorption state of said adsorbent based on the integrated value calculated by said humidity integrated value calculating means.

* * * * *